US005292296A

United States Patent [19]

Davignon

[11] Patent Number: 5,292,296

[45] Date of Patent: Mar. 8, 1994

[54] BALANCE BOARD

[76] Inventor: Barry J. Davignon, 2709 Sibley Ave., Terre Haute, Ind. 47803

[21] Appl. No.: 945,342

[22] Filed: Sep. 15, 1992

[51] Int. Cl.[5] ..... A63B 22/16

[52] U.S. Cl. ..... 482/146; 482/79; 472/135

[58] Field of Search ..... 482/79, 80, 105, 146, 482/147; 472/25.135; 602/29

[56] References Cited

U.S. PATENT DOCUMENTS

| | | | |
|---|---|---|---|
| D. 224,601 | 8/1972 | Cone | 472/135 |
| 1,868,765 | 7/1932 | Reynolds | 482/146 |
| 2,585,342 | 2/1952 | Morgan | 602/29 |
| 2,726,845 | 12/1955 | Hyslop, Jr. et al. | 482/146 |
| 2,930,613 | 3/1960 | Katz | 482/146 |
| 2,941,801 | 6/1960 | Pedersen | 482/146 |
| 3,024,021 | 3/1962 | Coplin et al. | 482/146 |
| 3,523,526 | 8/1970 | Phelps | 602/29 |
| 3,612,519 | 10/1971 | Larson | 482/147 |
| 3,854,717 | 12/1974 | Judkins et al. | 482/146 |
| 4,700,947 | 10/1987 | Heatwole | 482/146 |

*Primary Examiner*—Richard J. Apley
*Assistant Examiner*—Jeanne M. Mollo
*Attorney, Agent, or Firm*—H. John Barnett

[57] ABSTRACT

A recreation and exercise device having spaced, rotatable footpads, a crossboard integrally connecting the footpads, and one or more ground contacting members for supporting the device above the ground when balanced by the user standing on the footpads. The ground contact may comprise a pair of rounded pivots disposed under the crossboard just inwardly from the footpads. Also contemplated is a horizontal, annular ground contact member disposed below the crossboard intermediate the footpads.

3 Claims, 5 Drawing Sheets

BALANCE BOARD

BACKGROUND OF THE INVENTION

1. Field of the Invention

This invention pertains to recreation or exercise devices which are used by one person to develop balancing skills, and to amuse others who are observing the balancing effort. The balance board is somewhat similar to a pogo stick and other toys which require some level of balancing skill to use.

2. Description of the Related Art

The following patents are directed to amusement devices of this general type:

| Patent Number | Inventor/Owner | Date |
|---|---|---|
| 4,275,881 | Armstrong | 1981 |
| 4,492,374 | Lekhtman et al | 1985 |
| 4,515,362 | Chin-Lung Lin | 1985 |
| 4,696,467 | Markow | 1987 |
| 4,687,198 | Smith | 1987. |

None of the above patents show a balance board having one or more contact points with the ground which can be manipulated to "walk", or move horizontally, by the user shifting body weight from one foot to the other.

Probably the closest similar device known to applicant is the balancing ladder used by circus and exhibition performers. These are wider than normal ladders, and are positioned vertically. The user tips the ladder from side to side while balancing on the rungs. Because the user's feet are positioned inside the pivot points, the user must initially lift the side rail and its corresponding pivot with a combined hand and foot motion. In contrast, applicant's device has the pivot points disposed inside the user's feet, so the balancing motion can be commenced by a downward motion of the foot opposite the pivot to be lifted, and no side rails are required. The balancing ladder requires more skill to operate than applicant's devices. It is more like stilt walking, except that the pivot points are connected by the ladder rungs at a fixed distance from each other.

SUMMARY OF THE INVENTION

This invention is directed to a recreation and exercise device having spaced footpads, a crossboard integrally connecting the footpads and one or more ground-contacting members for supporting the device above the ground when balanced by the user standing on the footpads. The device may be "walked" horizontally by the user shifting body weight from one footpad to the other, and back. The ground contact members may be hemispherical balls, and can be fixed or rotatable. A single ground contact member may be of circular configuration having an outer, circular edge which contacts the ground anywhere around its edge, depending on the shifting of the user's body weight.

DESCRIPTION OF THE PREFERRED EMBODIMENT

Figure 1:
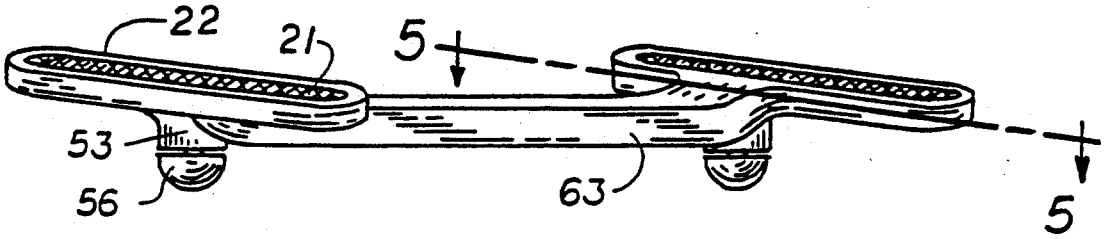
FIG. 1 is a perspective view of a presently preferred embodiment of the balance board.

FIG. 1 shows the presently preferred embodiment of the balance board which consists of two footpads 22. Non-skid surfaces 21 cover the tops of the footpads 22.

Pivot supports 53 connect to and support pivots 56 which are disposed below the footpads 22. Crossbar 63 interconnects between the footpads 22 which are slightly larger than an adult's foot, and are rigidly fixed at right angles to the crossbar 63 at a distance slightly larger than an adult's shoulder width.

The pivots 56 are movably mounted in the pivot supports 53. The pivots supports 53 are fixed to the bottom of the crossbar 63 and are inwardly spaced two to three inches from the center of each footpad 22. The pivot supports 53 may vary in length. As the height of pivot supports 53 increases, the skill required to operate the balance board increases. The footpads 22, crossbar 63 and the pivot supports 53 can all be molded as a single piece of plastic, or may be made from metal, or other materials, including wood and wood particles.

Figure 2A:
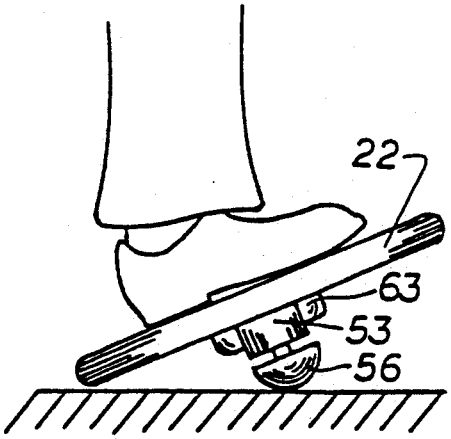
FIG. 2A is a side view of the balance board shown in FIG. 1 in a stable position.
Figure 2B:
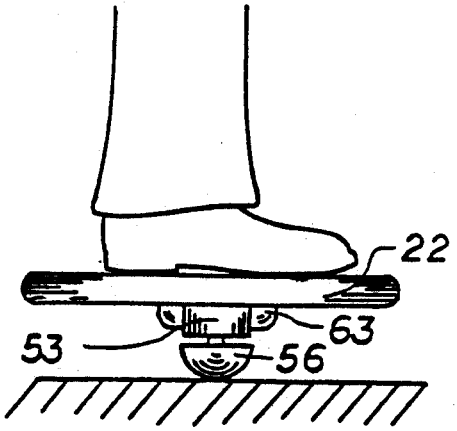
FIG. 2B is similar to FIG. 2A, and shows an unstable position.

FIG. 2A and FIG. 2B show a side view of the balance board shown in FIG. 1 with a person standing on it. In FIG. 2A the balance board is in a stable position with both pivots 56 and two tips of the footpads 22 rested on the ground. FIG. 2A also shows the position of a person's legs and feet when the balance board is first mounted. If the pivot supports 53 are taller than shown in FIG. 1, 2A and 2B, the balance board must be stabilized in an upright position while the operator is mounting the unit. FIG. 2B shows the balance board in a balanced or upright position with the footpads parallel to the ground.

Figure 3A:
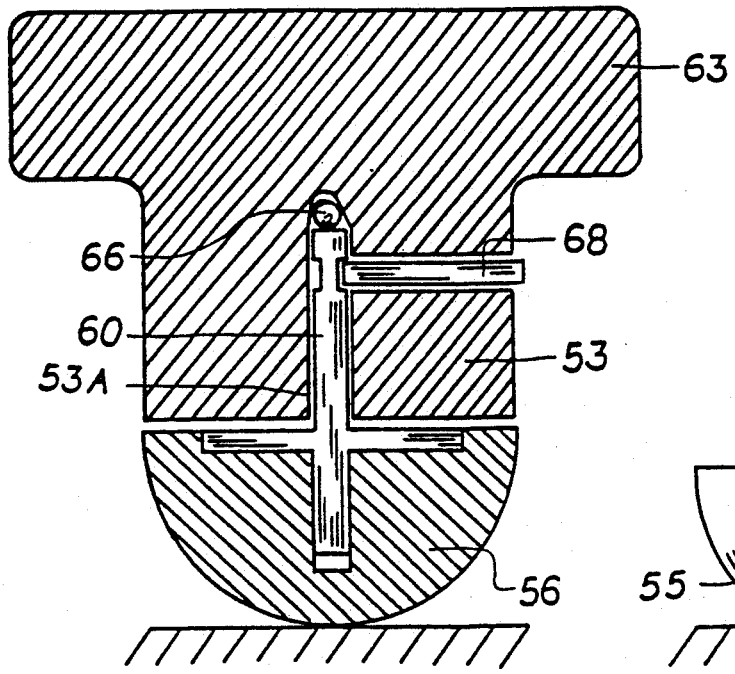
FIG. 3A is an enlarged sectional view taken on line 5—5 of FIG. 1.

FIG. 3A shows the movabe pivot 56 in more detail. The movable pivot 56 is hemispherical and contacts the ground at a point. The pivot 56 is preferably made of rubber for both indoor and outdoor use. A steel pivot axle 60 is firmly secured to the pivot 56 at its lower end and extends upwardly into an axial opening 53A in the pivot support 53. The upper end of the pivot axle 60 rotates freely against a ball bearing 66. This arrangement allows the pivot 56 to rotate freely about the vertical axis of the pivot support 53. A retaining pin 68 is used to keep the pivot axle 60 from falling out of the pivot support 53 when the unit is lifted off of the ground.

Figure 3B:
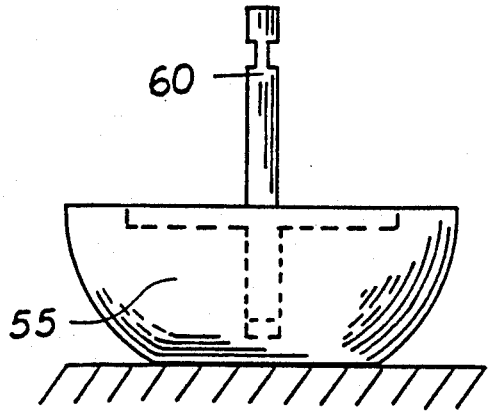
FIG. 3B is an enlarged side view of a modified pivot in contact with a horizontal surface.

FIG. 3B shows a variation from the pivot 56 shown in FIG. 3A. Flat pivot 55 has an area of contact with the ground in contrast to the point contact of the rounded pivot 56. The larger contact area of pivot 55 increases stability and makes balancing easier.

Figure 4:
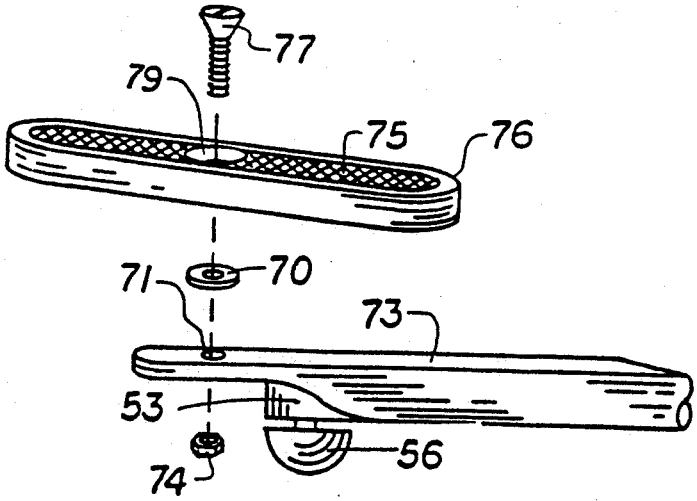
FIG. 4 is an exploded perspective view with parts broken away showing a second embodiment of the balance board having movable footpads.

FIG. 4 shows modified footpads 76 which swivel horizontally about the center of the modified footpads 76. A retaining bolt 77 is placed through an opening 79 in the modified footpad 76 and is further passed through a washer 70 and then through a second opening 71 in a modified crossbar 73. The bolt 77 is retained by a retaining nut 74. The retaining nut 74 holds the assembly together, but allows the modified footpads 76 to swivel freely. The washer 70 provides a surface to assist in swivelling. A modified non-skid surface 75 is needed to accommodate the hole 79 in the modified footpad 76. Means may also be provided for locking the swivelling footpads 76 at any angle relative to the crossbar 73.

Figure 5A:
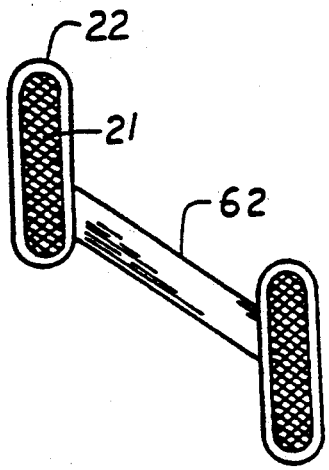
FIG. 5A is a top plan view showing a third embodiment of the balance board.
Figure 5B:
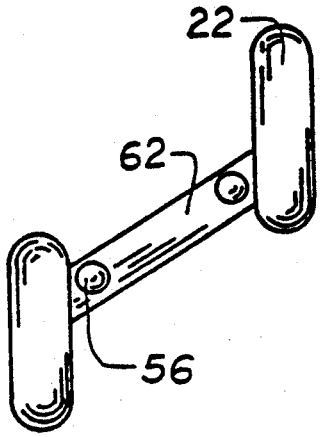
FIG. 5B is a bottom view of the balance board shown in FIG. 5A.
Figure 6A:
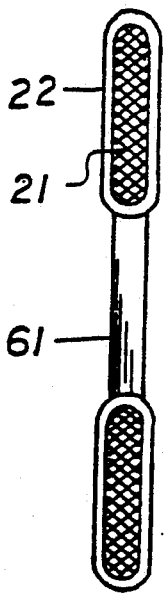
FIG. 6A is a top plan view of a fourth embodiment of the invention.
Figure 6B:
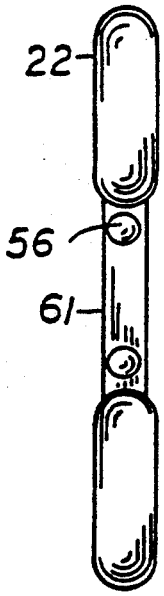
FIG. 6B is a bottom view of embodiment shown in FIG. 6A.

FIGS. 5A, 5B, 6A and 6B show additional embodiments of the invention, which are similar to FIG. 1 except that the footpads 22 are fixed to the modified crossbars 62, 61 at angles other than right angles. FIGS. 5A and 5B show the top and bottom views of a balance board in which modified crossbar 62 connects the footpads 22 at a 45 deg. (135 deg.) angle relative to the crossbar 62. FIGS. 6A and 6B show the top and bottom views of a balance board with a modified crossbar 61 which connects the footpads 22 at a 0 deg. (180 deg.) angle relative to the crossbar 61. The embodiment includes all fixed angles of the footpads 22 and crossbar, with 45 deg. and 0 deg. being the most likely variations.

In FIGS. 5B and 6B, it can be seen that the pivots 56 are positioned inboard from the corresponding footpad 22. Placing footpads 22 closer together raises the level of difficulty for a person using the balance board, making the exercise more challenging.

Figure 7:
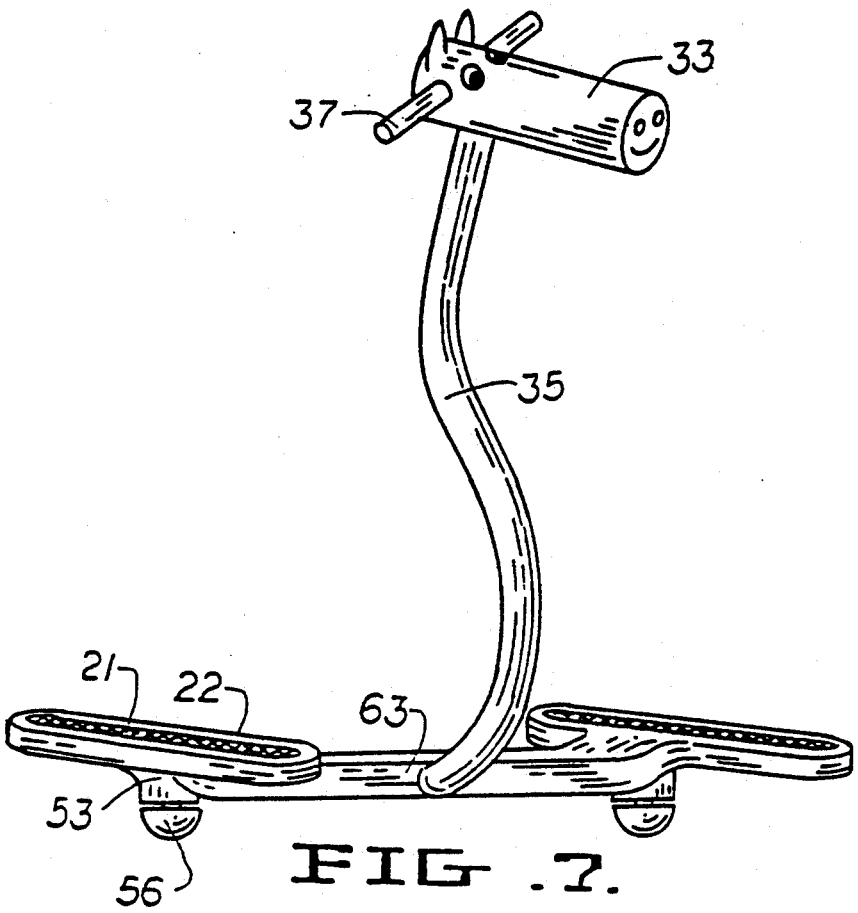
FIG. 7 is a perspective view of a fifth embodiment of the invention.

FIG. 7 shows another embodiment of the invention, which is similar to the embodiment of FIG. 1, except that a handle assembly is provided. The handle assembly includes a connecting bar 35, handle bars 37 and an embellishment consisting of a toy animal head 33. A system consisting of two connecting bars and handles, one for each hand is also contemplated. This modified balance board is especially intended for young children and beginners. The handle assembly provides added stability, making the modified balance board easier to operate.

Figure 8:
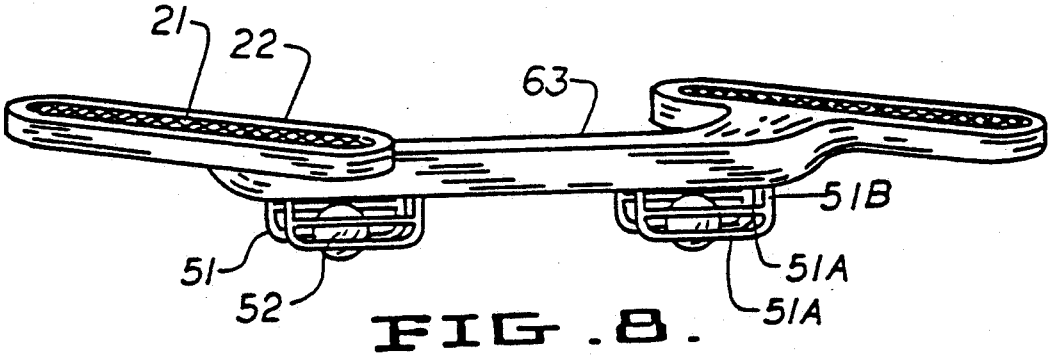
FIG. 8 is a perspective view of a sixth embodiment of the invention.

FIG. 8 shows a modified balance board in which contact rollers 52 and retaining cages 51 replace the pivots 56 and pivot supports 53. When one side of the unit is lifted off the ground, the opposite side in contact with the ground will be able to pivot and roll on the ground. The pivoting and rolling is accomplished through the contact rollers 52. The retaining cage 51 restricts the movement of the contact roller 52 by trapping the contact roller 52 in a parallel track 51A of metal rods 51B. The contact rollers 52 move only along the length of the retaining cage 51. The amount of rolling is limited by the length of the parallel track 51A of the retaining cage 51.

Figure 9A:
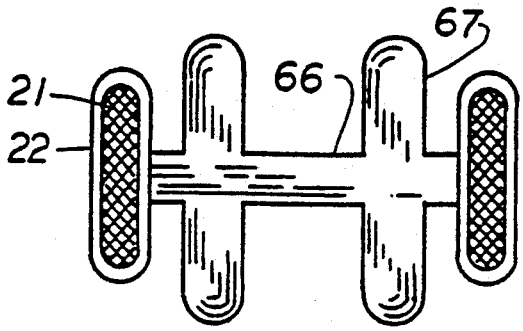
FIG. 9A is a top plan view of a seventh embodiment of the invention.
Figure 9B:
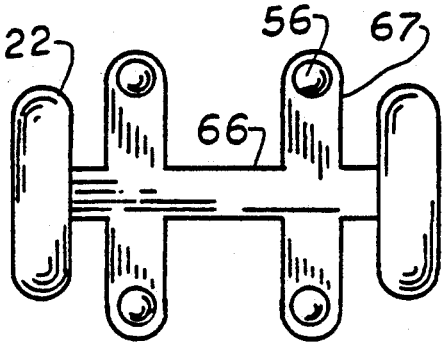
FIG. 9B is a bottom plan view of the embodiment shown in FIG. 9A.

FIGS. 9A and 9B show a modified balance board having four pivots 56, modified crossbar 66 and crossbar extensions 67. Crossbar extensions 67 support the four pivots 56 in a position away from under the crossbar 66. FIG. 9B shows the location of the pivots 56. Additional pivots make the balance board more stable and easier to use.

Figure 10:
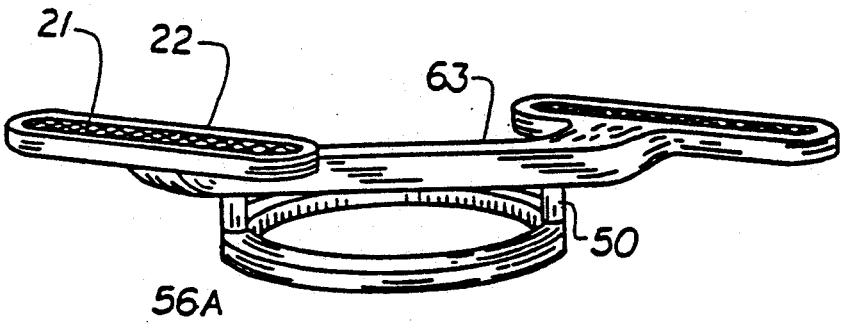
FIG. 10 is a perspective view of an eighth embodiment of the invention.

The modified balance board shown in FIG. 10 incorporates a contact ring 56A and ring supports 50 instead of the pivots 56, as shown in the prior embodiments. The ring supports 50 are disposed below the crossbar 63 outwardly from its midportion, and just inwardly from the footpads 22.

The ring supports 50 firmly connect the contact ring 56A to the crossbar 63 and may vary in vertical height. As the vertical height of the ring supports 50 is increased, the skill required to operate the ring base balance board is greater. The contact ring 56A provides a much larger support surface for the balance board, thereby increasing the "at rest" stability.

What is claimed is:

1. A balancing device comprising:

ground contact means for pivotally contacting a horizontal surface;

a main body connected to the ground contact means, said main body being normally disposed horizontally above the ground contact means when the balancing device is in use, said main body including pivot supports for the ground contact means, each pivot support having a vertical axial opening;

first and second foot receiving means supported by the main body and normally disposed outward from the main body at opposite sides thereof, said foot receiving means comprising footpads; and the ground contact means comprising first and second hemispherical pivots, each pivot including a pivot axle having upper and lower ends and an intermediate portion, the lower end being firmly secured to the corresponding hemispherical pivot, the pivot axle extending upwardly into the vertical, axial opening in the pivot support, and bearing means disposed above the pivot axle in the axial opening, the ground contact means being disposed below the main body and inwardly from the first and second foot receiving means, and connected to the main body and the first and second foot receiving means to support a user standing on the foot receiving means, whereby the device can be moved by the alternate shifting of the user's body weight from one footpad to the other.

2. The balancing device of claim 1, including groove formed around the periphery of the intermediate portion of the pivot axle, and a retaining pin extending from the pivot support into the groove to hold the pivot axle and the herispherical pivot in place.

3. The balancing device of claim 1, in which the first and second foot receiving means comprise footpads which are rotatably mounted on the main body to be independently movable to any generally horizontal angle relative the horizontal axis of the main body which extends from one footpad to the other.

* * * * *